United States Patent [19]

Kun et al.

[11] 4,253,519

[45] Mar. 3, 1981

[54] ENHANCEMENT FOR FILM CONDENSATION APPARATUS

[75] Inventors: Leslie C. Kun; Elias G. Ragi, both of Williamsville, N.Y.

[73] Assignee: Union Carbide Corporation, New York, N.Y.

[21] Appl. No.: 51,190

[22] Filed: Jun. 22, 1979

[51] Int. Cl.[3] ..... F28B 9/08

[52] U.S. Cl. ..... 165/110; 62/290; 165/184

[58] Field of Search ..... 165/110, 111, 133, 181, 165/183, 184, 180; 62/285, 288, 289, 290

[56] References Cited

U.S. PATENT DOCUMENTS

| | | | |
|---|---|---|---|
| 496,757 | 5/1893 | Theisen | 165/184 |
| 925,506 | 6/1909 | Quiggin | 165/177 |
| 2,197,243 | 4/1940 | Moran | 165/177 |
| 2,469,729 | 5/1949 | Hunter | 165/133 |
| 2,615,686 | 10/1952 | Davidson | 165/184 |
| 2,749,600 | 6/1956 | Persson | 165/172 |
| 2,983,115 | 5/1961 | Caswell | 165/110 |
| 3,002,729 | 10/1961 | Welsh | 165/183 |
| 3,067,084 | 12/1962 | Nalle, Jr. | 156/167 |
| 3,154,141 | 10/1964 | Huet | 165/133 |
| 3,168,137 | 2/1965 | Smith | 165/110 |
| 3,291,704 | 12/1966 | Diedrich et al. | 165/166 |
| 3,298,427 | 1/1967 | Erb | 165/133 |
| 3,358,750 | 12/1967 | Thomas | 165/110 |
| 3,508,608 | 4/1970 | Roe | 165/111 |
| 3,885,622 | 5/1975 | McLain | 165/179 |
| 3,906,605 | 9/1975 | McLain | 165/133 |
| 4,074,753 | 2/1978 | Schmittle et al. | 165/184 |

FOREIGN PATENT DOCUMENTS

| | | | |
|---|---|---|---|
| 2406974 | 8/1975 | Fed. Rep. of Germany | 165/110 |
| 10616 | of 1891 | United Kingdom | 165/184 |
| 6700 | of 1892 | United Kingdom | 62/310 |

OTHER PUBLICATIONS

Thomas, Enhancement of Film Condensation Heat Transfer Rates on Vertical Tubes by Vertical Wires, IEC Fundamentals, 6, pp. 97–103, 1967.

Thomas, Enhancement of Film Condensation Rate on Vertical Tubes by Longitudinal Fins, AICHE Journal, 14, pp. 644–649, 1968.

*Primary Examiner*—Sheldon J. Richter

*Attorney, Agent, or Firm*—Alvin H. Fritschler

[57] ABSTRACT

A system for enhancing the performance of the external condensing surfaces of the vertical tubes of a film condensation heat exchanger comprising a network of enhancement elements adjacent the tube surface to collect the condensate into rivulets and connecting elements wrapped around and bonded to the enhancement elements to maintain the latter in their proper positions. In a preferred embodiment, both the enhancement and connecting elements are made of a wettable plastic polymeric material in the form of a sleeve to slip over the condenser tube as a prefabricated unit.

12 Claims, 8 Drawing Figures

FIG. 1
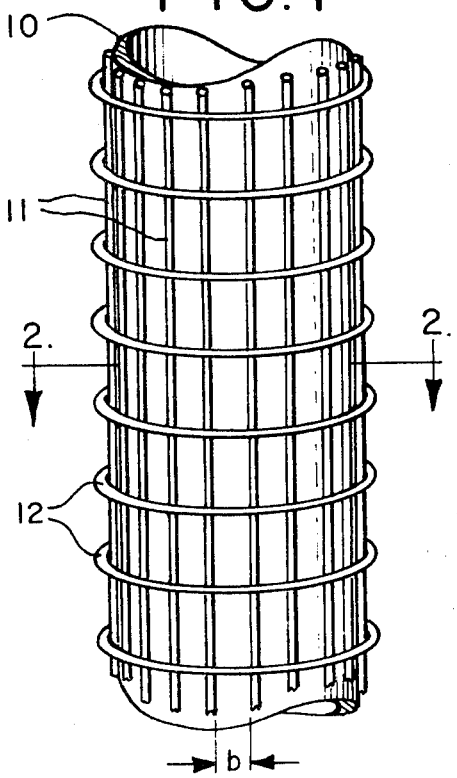
FIG. 4
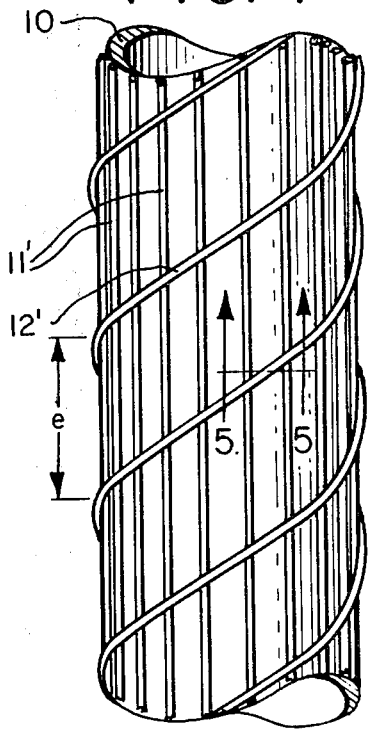
FIG. 5
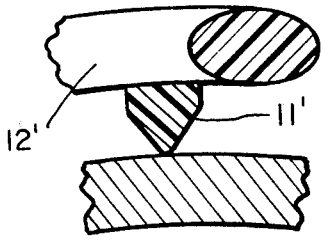
FIG. 2
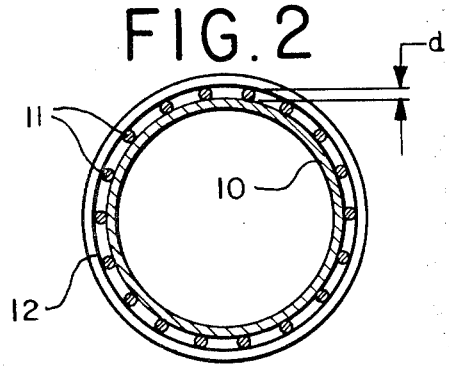
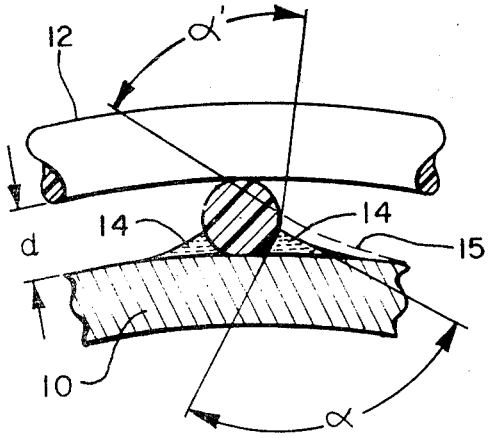
FIG. 3
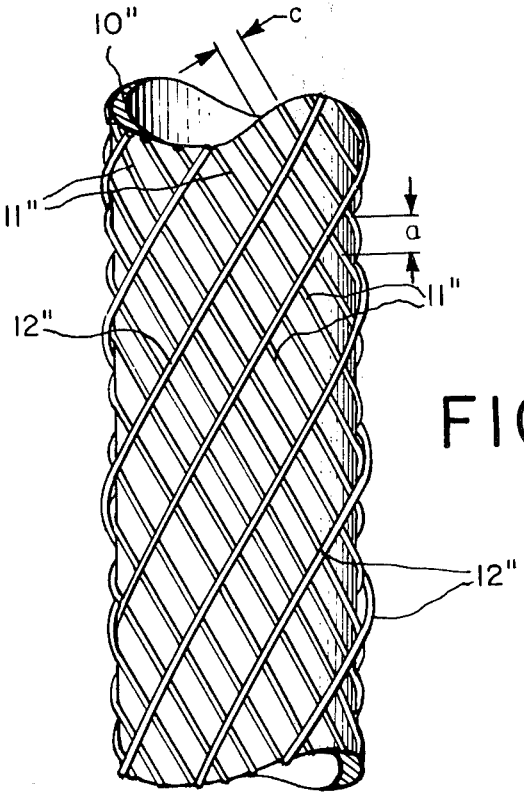
FIG. 6

ENHANCEMENT FOR FILM CONDENSATION APPARATUS

This invention relates to a system for the enhancement of the external condensing surfaces of vertical tubes of film condensation heat exchangers to improve the efficiency thereof.

Resistance to heat transfer develops as liquid forms on a condensation surface. This liquid coating isolates the covered surface from surrounding vapor and acts as an insulator to hinder further condensation. While the vertical alignment of the surfaces of a vertical tube results in gravity drainage, the layer tends to increase in thickness in the downward direction. If the liquid layer can be substantially thinned and the excess removed, a more effective heat transfer surface can be obtained with a major reduction in heat transfer resistance. The reduction of heat transfer resistances in thermal energy systems can be advantageously utilized in several ways, as by operating with a lesser temperature difference across the transfer surface, with a smaller condension surface area, or at a higher system efficiency (energy flux).

The performance of heat exchange devices of the condensing type may be measured by the ability of the heat transfer wall to dissipate the heat (as by boiling of fluid in contact with the other side of the wall) that is liberated by the condensing fluid. In many cases, however, the ability of the heat transfer wall to dissipate heat exceeds its ability to remove heat from condensation. The increase of boiling coefficients is illustrated by U.S. Pat. Nos. 3,384,154 and 3,454,081, and emphasizes the importance of equivalently large condensing coefficients.

The need for higher performance in condensing systems and the reduction of heat transfer resistance by reducing the accumulation of condensate upon the condensing surface are amply recognized in the art. Nevertheless, goals have not been satisfied, and this invention is directed to overcoming the shortcoming of prior enhancement systems for such condensing systems.

On smooth, wettable surfaces of vertically oriented condenser tubes, the depth of the condensate film increases along the downward length of the surface as condensate is formed and flows downward under the force of gravity. Prior art attempts to thin the liquid film on vertically oriented tubes includes treatment of the surface with a non-wettable coating to induce the beading and consequent dripping of the condensate. Alternatively, condensate stripping projections on an otherwise smooth tube surface help in the stripping off of the condensate along the length of the tube. Both of the techniques described are aimed at reducing the condensate buildup at the lower tube portions. The nonwettable surface treatments often introduce heat transfer resistance of the very type sought to be reduced, while condensate stripping projections are often expensive to fabricate, frequently allow the falling condensate to recollect on lower sections of the tube, and reduce the packing factor of the condenser tubes, all results which tend to offset any advantage derived from reducing condensate buildup at the lower surface portions.

As a supplemental or an alternative method for reducing the condensate film thickness on vertical tubes, it is known that surface tension effects can be employed to concentrate the condensate into drainage rivulets through the employment of a variety of surface configurations which result in alternate convex and concave condensate surfaces and the resulting differential fluid pressures attendant therewith. The differential fluid pressures cause the condensate to flow from the convex-surfaced areas into the concave-surfaced areas, thinning the film in the former areas and concentrating it into drainage rivulets in the latter. In many instances, however, the increased cost of fabricating the undulating surfaces renders the system economically impractical.

U.S. Pat. No. 3,358,750 to Thomas is directed to a system for enhancing the film condensation heat transfer coefficient in vertically oriented condenser tubes through surface tension effects described generally above. The patent discloses that loosely attached radial projections along a line parallel to the tube axis provide a marked increase in the film condensation heat transfer coefficients. Such a system, however, involves the handling, placement and attachment of numerous individual wires or fins along the length of each tube of a condenser, with large condensers commonly comprising hundreds, even thousands, of feet of tubing. Such individualized fabrication of the tubes is an expensive technique for obtaining improved performances.

A primary object of the present invention is to provide an effective yet relatively inexpensive system for the enhancement of film condensation surfaces of vertical tubes.

Another object of the present invention is to provide a system for the enhancement of film condensation surfaces of vertical tubes which may be pre-fabricated apart from the condensation surface itself and subsequently readily and conveniently applied thereto.

A related object is to provide a system for the enhancement of film condensation surfaces which may be applied to existing smooth condenser tubes as well as to newly fabricated tubes.

Other objects and advantages of the invention will become apparent from the following detailed description of the preferred embodiments illustrated in the accompanying drawings in which:

FIG. 1 illustrates a vertically oriented condenser tube with a sleeve-type prefabricated enhancement of the present invention;

FIG. 2 is a sectional view along the section lines 2—2 of FIG. 1;

FIG. 3 is an enlarged fragmentary sectional view showing condensate rivulets adjacent an enhancement element.

FIG. 4 illustrates a vertically oriented condenser tube with an alternative embodiment of a sleeve-type enhancement of the present invention.

FIG. 5 is a sectional view along the section lines 5—5 of FIG. 4.

FIG. 6 illustrates a vertically oriented condenser tube with another alternative embodiment of a sleeve-type enhancement of the present invention.

Figure 7:
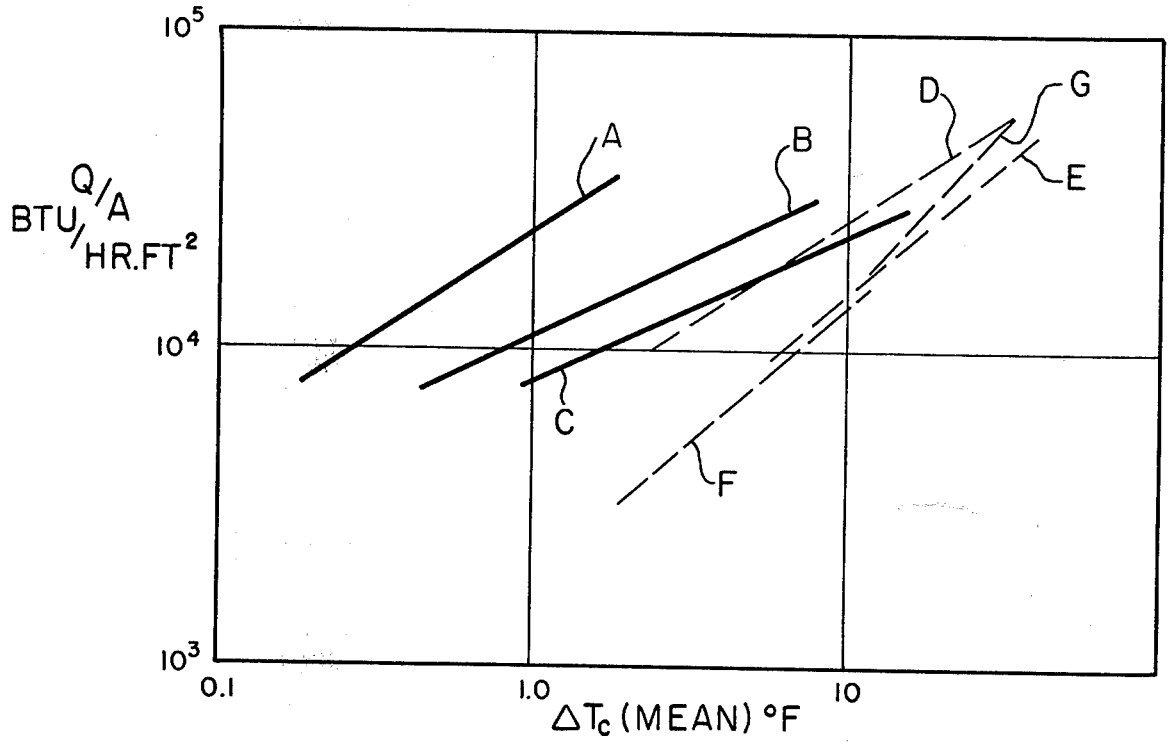

FIG. 7 displays performance data for the condensation of steam on a vertically oriented test tube with a sleeve-type enhancement of the type illustrated in FIGS. 1–3.

Figure 8:
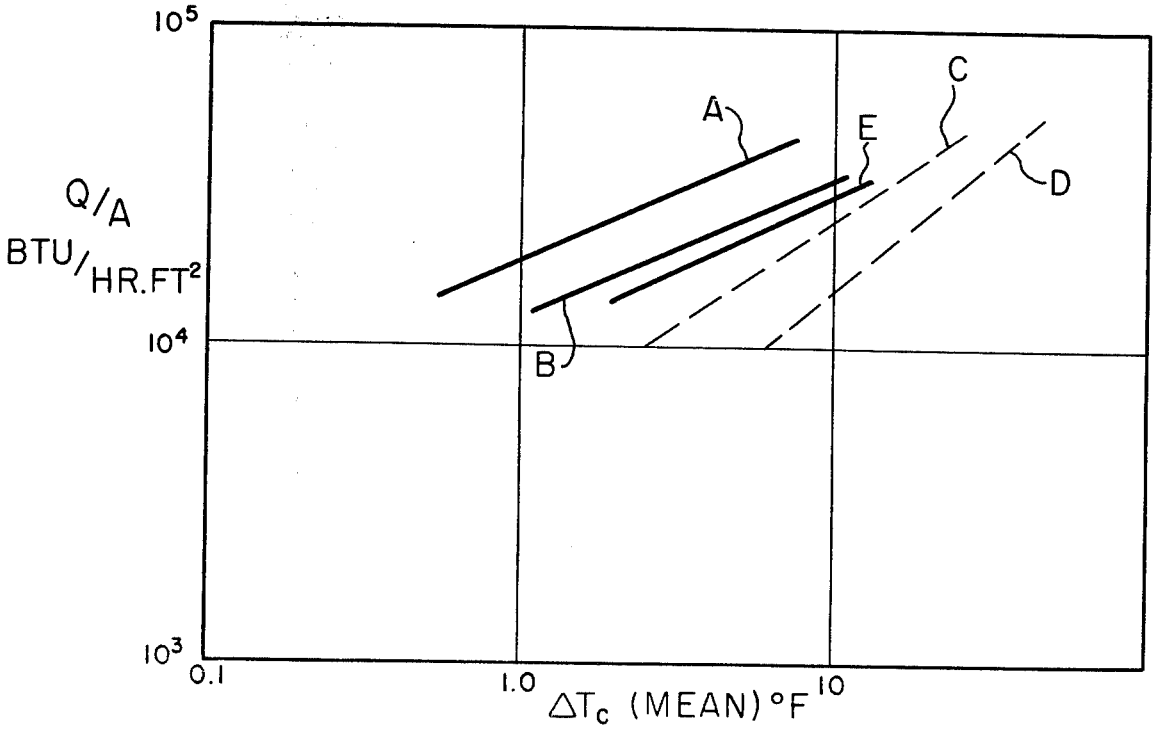

FIG. 8 displays performance data for the condensation of steam on vertically oriented test tubes with sleeve-type enhancements of the type illustrated in FIGS. 4–5.

While preferred embodiments are shown and will be discussed, it is not intended that the detailed character of the discussion should limit the invention to such particulars. On the contrary, the invention is to cover all modifications and adaptations falling within the spirit and scope of the invention as more broadly or generally characterized in the appended claims.

According to the present invention, an inexpensive yet highly effective condensation surface enhancement system for vertical tubes is provided by applying a network of what will herein be generally described as "enhancement elements" and "connecting elements" to an otherwise smooth condensing surface. For the purpose of the description which follows, an "enhancement element" is a strand-type member adapted to be positioned adjacent the condensing surface to collect condensate primarily through surface tension and, in some cases, also to intercept condensate undergoing gravity-induced flow. The "connecting elements" are strand-type members arranged normal to or obliquely to the enhancement elements and affixed onto them at the cross-over points. These connecting elements serve the function of maintaining the proper orientation and relative positioning of the enhancement elements, eliminating the requirement that the enhancement elements be individually attached to the condensing surface. FIG. 1 illustrates a vertically oriented condenser tube 10 having a network of enhancement elements 11 and connecting elements 12. The sectional view of FIG. 2 illustrates the orientation of the sets of elements relative to the condenser tube surface.

Significant fabrication costs associated with prior surface tension-effect enhancement systems are reduced in the present invention through prefabricating the network of elements as a sleeve into which the tube is inserted. This fabrication technique may be used not only with newly fabricated condenser tubes but also in the replacement of a damaged enhancement and the retrofitting of existing smooth-surfaced condenser tubes.

It is emphasized that the enhancement elements of the present invention serve the purpose of collecting condensate formed on the surface of the tube through the surface tension effects discussed above and are not extensions of the condensing surface area. Accordingly, the enhancement elements themselves neither need have a high thermal conductivity nor a good heat transfer relationship with the condenser tube surface, as in the case of surface extensions such as integrally machined fins, brazed wires, etc. It has been found that certain plastic polymeric materials provide highly satisfactory results in the present invention where the range of operating temperatures is compatible with the mechanical stability of the particular plastic. Beyond that, the primary consideration in selecting a plastic material for the enhancement and connecting elements is that the material be sufficiently wettable, i.e., have a sufficiently low contact angle, with the condensate with which it is to be used, to permit the formation of the requisite concave drainage rivulets adjacent the enhancement elements.

The maximum acceptable contact angle depends upon several factors, including the configurarion of the enhancement elements, their orientation relative to the condensing surface and the contemplated condensate loading. In FIG. 3 condensate 14 is illustrated having a contact angle of about 90° in conjunction with the circular cross section enhancement elements. It will be appreciated that for this configuration, the lower the contact angle, the higher (normal to the condensing surface) the condensate can rise on the enhancement element with the same condensate rivulet radius. See the dotted line 15 in FIG. 3 which has the same condensate rivulet radius but with a lower contact angle. This results in a desirable increased capacity for the condensate rivulet. While some materials might not have sufficiently small contact angles at ambient temperatures, at the elevated temperatures to which the condensing surfaces will be subjected during operation, the contact angles often decrease to acceptable levels. It will be appreciated that the specific acceptable contact angle depends primarily upon the cross-section of the portion of the enhancement element to be wetted by the condensate and the orientation of this portion to the condensing surface. The fundamental requirement is that a concave condensate surface be formed adjacent the enhancement element. A contact angle of less than 90° will assure this criterion is met with a wide range of enhancement element configurations, including circular and rectangular. Accordingly, as used hereinafter and in the amended claims, the term "wettable" as applied to polymeric materials incorporates within its meaning that the material has a maximum contact angle of about 90° with the condensate for the range of operating temperatures to which the apparatus is to be subjected. Among the specific polymeric materials suitable for steam condensation are: polypropylene, polycarbonate, polysulfone, nylon, polyethylene terephthalate, and high density polyethylene.

Plastic materials offer an additional advantage in the case of the sleeve-type enhancements for condenser tubes suggested above. Many plastic materials will accommodate a certain amount of elastic stretching and bending. Accordingly, when using such a material, the sleeve can be fabricated slightly smaller than the outside diameter of the tube so that when it is stretched elastically over the tube, at least a portion of the enhancement elements will maintain a touching relationship with the surface of the condensing tube 10. With this arrangement, the frictional forces between the sleeve and the tube surface will tend to maintain the sleeve properly positioned in the tube. In this regard, it should be noted that certain orthogonal network configurations inherently permit circumferential expansion by element bending as opposed to element stretching. This facility may be used in conjunction with the properties of the material itself to create the desired fit of the sleeve to the tube. In some instances, it may be desirable to bond the enhancement elements to the tube surface, either as a supplemental means for maintaining the proper positioning of the sleeve, or as a substitute for the frictional positioning technique described above. Although the specific bonding arrangement may vary from application to application, it is contemplated that at least in some instances, the plastic sleeves can be bonded to the tube surface by simply heating the assembly of the tube and sleeve.

Certain commercially available products have been found which, when utilized as condensing surface enhancements according to the present invention, have resulted in substantially improved performance over plain-surfaced tubes. Vexar, a polymeric product of the E. I. duPont Nemours Company, is typically formed of filaments into a prefabricated mesh of sheet or tubular form and which may be employed as a packaging material, e.g., as potato and onion bags. Similarly Naltex, a polymeric product of the Nalle Plastics Company, is typically formed into a prefabricated tubular mesh which may be employed for decorating purposes e.g., as a decoration for candles, glassware, etc. Prefabricated networks formed from both of these materials have been tested as film condensation enhancements for vertically oriented condenser tubes. The results of a series of such tests are presented below.

Describing the configurations of the enhancement elements 11 and the connecting elements 12 of FIGS. 1–3 in more detail, while the strands may be extruded in a variety of cross sectional configurations, enhancement elements of circular cross section, as opposed to, for example, a rectangular, fin-type cross section, have the advantage of accommodating liquid-solid contact angles of on the order of 90° (see FIG. 3) while at the same time minimizing the percentage of the condensing surface which is inactivated through the presence of the enhancement elements itself. FIG. 5 is a cross sectional view similar to that of FIG. 3 showing enhancement elements 12' shaped into a "V" at the point of contact with the tube. Results comparing the performance of this shape of enhancement elements with circular shaped ones are also presented below.

The configuration of the connecting elements 12 is generally not a critical factor inasmuch as these elements normally do not enter into or otherwise affect the collection of the condensate. Nevertheless, the overall height of the enhancement elements and connecting elements normal to the tube surface should be a minimum consistent with accommodating the condensate rivulets without inducing bridging of the condensate between the condensing surface and the connecting elements. Connecting elements of circular cross section, as illustrated in FIG. 1, are effective, yet inexpensively fabricated and oriented.

The specific optimum orientation of the enhancement elements relative to the condensing surface may vary from application to application. In the case of long tubes with high condensate loading which, without enhancement, experience excessive liquid depths at the lower tube portions, vertically oriented elements maximize the gravity-induced flow rate of condensate down, and eventually from, the tube. The embodiment of the invention illustrated in FIGS. 1 and 2 shows such axially aligned enhancement elements.

In situations where condensate build-up at the lower tube portions is not a severe problem, e.g. short tubes, it may be desirable to spirally wind the enhancement elements around the tube. Such an arrangement is illustrated in FIG. 6. This arrangement combines the surface tension effect of concentrating the condensate into rivulets with the interception of downwardly flowing condensate as a result of the horizontal component of the enhancement element orientation. So long as the condensate drains rapidly enough to avoid build up on the upper surfaces of enhancement elements 11'' to the point of spilling over (with the undesirable re-entry of condensate onto the condensing surface), such an arrangement shortens the vertical travel of the condensate on the active condensing portion of the tube to, effectively, the vertical spacing "a" between adjacent elements. It should be noted that offsetting considerations include the increased length of travel of the condensate along the spiral path of the enhancement element and the decreased effects of gravity to promote the gravity-induced flow. Accordingly, most spiral wrap arrangements will have to be optimized for specific applications.

The arrangement of the connecting elements may vary widely from application to application. Since the connecting elements perform the function of maintaining the proper positioning of the enhancement elements, it is desirable to provide a minimum of such elements consistent with serving their intended purpose. Accordingly, the more self-supporting the enhancement elements are, the fewer connecting elements need be provided. In the embodiment illustrated in FIGS. 1 and 2, the connecting elements 12 are shown wound circumferentially at about 90° to the axis of the tube. In the embodiments illustrated in FIG. 4 and 6 connecting elements 12' and 12'' are shown helically wound with a helix angle of about 45° and 22½°, respectively. Generally, the alignment of connecting elements at an oblique angle to the axis of the tube is preferred to an alignment of 90° because of the easier expansion of the enhancement for installation onto the tube.

Apart from considerations discussed above regarding the orientation of the enhancement elements, the spacing between adjacent elements has been found to be important to the performance of vertically oriented condensing tubes with surface enhancements of the present invention. With the embodiment of FIGS. 1 and 2, where the concentration of the condensate into drainage rivulets is accomplished through surface tension effects alone, the failure to provide sufficient spacing "b" between adjacent enhancement elements 11 will result in excessive inactivation of the condensing surface. This inactivation results from insulation of the surface by the enhancement elements themselves and by bridged condensate therebetween (item 14 in FIG. 3), leading to poor performance, even relative to a smooth-surfaced tube. On the other hand, excessive spacing between the adjacent enhancement elements 11 will result in reduced influence of the elements on the intermediate tube surface, diminishing the benefits derived from the surface enhancement.

With the embodiment of FIG. 6, the spacing between adjacent enhancement elements 11'', both the perpendicular spacing "c" and the vertical spacing "a", are a function of the tube diameter, the helix angle and the number of enhancement elements. Insofar as the surface tension effects are concerned, the observations above regarding inter-element spacing with vertically arranged elements are generally applicable in selecting the optimum perpendicular spacing "c" between enhancement elements 11''. The optimum vertical spacing "a" depends upon several factors including primarily the fluid properties such as surface tension, density and viscosity of the condensate.

The following examples present experimental data from the testing of enhancements of the invention with both vertically and spirally oriented enhancement elements.

EXAMPLE I

A condensation enhancement of the type illustrated in FIGS. 1 and 2 was tested on a vertically oriented condensation tube section in steam condensation service. The enhancement was fabricated of polypropylene elements having a diameter of 0.060 inches. The condensation tube section was a 1⅛ inch diameter copper tube having an active length of about 12 inches. The enhancement elements 11 were axially oriented on the tube surface, as illustrated in FIG. 1, and circumferentially spaced about 0.17 inches apart. The connecting elements 12 were arranged normal to the enhancement elements 11 and also had a spacing of about 0.17 inches.

The tube section with the condensation enhancement applied was positioned vertically within a chamber and connected for flowing cooling water through the tube. Steam at saturation temperature and controlled pressure was admitted to the chamber externally of the tube. Provision was made for preloading the upper end of the tube with water at its boiling point and at controlled rate of flow in order to simulate operation of a lower one-foot length of a long vertical tube. Condensate was collected, reboiled against an electric heater, and returned to the chamber in a closed system. Measurements were made of tube wall temperature, condensing pressure and temperature, and power consumption by the electric heater.

Results of the tests are shown in FIG. 7. Curve A is for zero-preload condition, Curve B is for sufficient preloading to simulate the lower-most one-foot section of a 10-foot long tube, and Curve C is for the lower-most one-foot section of a 30-foot long tube. For comparison, Curve D shows data taken on a bare tube (without the condensation enhancement) and without preloading. Curve E is data for the bare tube preloaded to simulate the lower-most one-foot section of either a 10-foot or 20-foot long tube. Thus, for corresponding conditions of preloading, Curve A should be compared with Curve D and Curve B with Curve E.

Under zero preload conditions (Curves A and D), it is evident that at any selected value of heat flux within the range of FIG. 7, the enhancement of this invention improves performance by a factor greater than 8. For example, at a heat flux of 10,000 Btu/hr-ft$^2$, the mean temperature drop across the condensate film for the enhanced tube is 0.27° F. compared with 2.4° F. for the plain tube. The corresponding condensing coefficients are 37,000 Btu/hr-ft$^2$-°F. for the enhanced tube and 4200 Btr/hr-ft$^2$-°F. for the plain tube.

Under preloaded conditions simulating the lower-most one-foot section of a 10-foot long tube (Curves B and E), the enhancement of this invention improves performance by factors of approximately 3 to 8 within the range of heat flux values shown in FIG. 7. For example, at a heat flux of 10,000 Btu/hr-ft$^2$, the mean temperature drop across the condensate film for the enhanced tube is 0.8° F. compared with 6.2° F. for the plain tube. The corresponding condensing coefficients are 12,500 Btu/hr-ft$^2$-°F. for the enhanced tube and 1600 Btu/hr-ft$^2$-°F. for the plain tube.

Curve C shows that even under conditions of very heavy condensate loading, the present enhancement improves significantly over a plain tube. As would be expected, the improvement tends to be reduced at very high values of heat flux where the enhancement elements may approach their flooding point. It should be understood, however, that the enhancement of FIGS. 1 and 2 can be modified for better adaptation to the heavily loaded conditions of Curve E, for example, by increasing the dimension of the enhancement elements.

Curve F of FIG. 7 is a plot of predicated condensing performance of a 10-foot vertical tube calculated in accordance with the well-known Dukler correlation. It is noted that the test data of Curve E is in excellent agreement with the Dukler prediction.

EXAMPLE II

For comparative purposes, condensation enhancement similar to that employed in Example I was tested to determine the effect of fusing the condensation element 12 into the enhancement elements 11 to create an intersecting, as opposed to an overlying (as illustrated in FIGS. 2 and 3) relationship, thereby reducing the spacing "d" between the tube surface and the connecting element 12. The enhancement mesh was constructed of polypropylene filaments about 0.060 inch diameter spaced about 0.25 inch apart. Orientation was essentially as shown in FIG. 1 with the angle of cross-over about 90°.

The test was conducted as set forth above in connection with Example I with no condensate preloading. The data is shown by Curve G. Comparing this data to Curves A and D, the performance of the tube with the enhancement of this Example was even poorer than that of a bare tube (Curve D). Accordingly, in the case of circular elements, the cross-over points should approach point contact to maximize the connecting element-to-tube surface spacing "d" to avoid the promotion of condensate bridging and the condensate holdup associated with such an occurrence.

EXAMPLE III

A polypropylene enhancement of the type shown in FIGS. 4 and 5 was tested in a system similar to that described in connection with Example I. As in that Example, a 1⅛ inch diameter copper tube about 12 inches long was employed. The enhancement elements were of the cross section illustrated in FIG. 5 and approximately 0.055 inches across. They were spaced about 0.085 inches apart around the circumference of the tube. The connecting elements were about 0.055 inches in diameter and aligned obliquely to the enhancement elements at a helix angle of about 45°. The vertical spacing "e" was about 1⅛ inches. The test tube section fitted with the enhancement and installed vertically in the apparatus with steam condensing against the enhancement. FIG. 8 shows the results of tests under several condensate loading conditions. Curve A depicts performance of the tube without condensate preloading while Curve B is performance with preloading to simulate the lower-most one-foot section of a 20-foot tube. Curves C and D of FIG. 8 correspond to Curves D and E of FIG. 7 and are repeated for the convenience of comparison with un-preloaded and preloaded bare tubes, respectively.

Under zero preload conditions, the enhanced surface (Curve A) performed better than the bare tube (Curve C) by factors between 3.5 and 7.5 within the range of heat flux values employed. For example, at a heat flux of 20,000 Btu/hr-ft$^2$, the enhanced surface developed a mean temperature drop across the condensate film of 1.2° F. compared with 7° F. for the bare tube. The corresponding condensing coefficients are 16,700 Btu/hr-ft$^2$-°F. and 2800 Btu/hr-ft$^2$-°F. respectively.

Under condensate-loaded conditions, the enhanced surface (Curve B) performed better than the bare tube (Curve D) by factors between 2.4 and 6.2 within the range of FIG. 8. For example, at 20,000 Btu/hr-ft$^2$, the enhanced surface developed a mean temperature drop across the condensate film of 3.1° F. compared with 14° F. for the bare tube. The corresponding condensing coefficients are 6400 Btu/hr-ft$^2$-°F. and 1400 Btu/hr-ft$^2$-°F. respectively.

EXAMPLE IV

A condensation enhancement differing somewhat from that employed in Example III was also tested. In this Example, the enhancement elements were substantially circular in cross section, as opposed to having the cross sectional shape illustrated in FIG. 5. In addition, more connecting elements were employed to yield a vertical spacing "e" of about $\frac{3}{8}$" with the same helix angle of approximately 45°. The test was run as in the previous Examples with a preloading to simulate the lower-most one-foot of a 20-foot long tube. Curve E of FIG. 8 depicts the performance data. Comparison of Curve B, that for the enhanced surface of Example III under the same conditions, with Curve E shows the combined value of reducing the number of connecting elements and of minimizing the masking effect of the enhancement elements through the use of the "V" cross section.

EXAMPLE V

An enhancement similar to that shown in FIGS. 1 and 2 and that tested in Example I was tested for condensing Refrigerant 22 (chlorodifluoromethane). The enhancement was structured of polyethylene strands 0.040 inch in diameter intersecting at about 90°. A $1\frac{1}{8}$ inch copper tube was again employed. Both the inner, enhancement and the outer, connecting strands were spaced about 0.083 inch apart. The specimen was tested in a system similar to previously described tests, and the same tube was tested without the enhancement for comparison. At a heat flux of 10,000 Btu/hr-ft$^2$, the enhanced tube provided condensing coefficients between 414 and 446 Btu/hr-ft$^2$-°F. compared with values between 225 and 231 for the bare tube.

It should be noted that the surface of the foregoing paragraph was not specifically "tailored" or optimized for condensing Refrigerant 22. The fluid has a surface tension about one-ninth that of water, and a latent heat of vaporization about one-twelfth that of water. Thus, unit transfer of heat will produce a relatively large volume of condensate which will form menisci against the enhancement elements of relatively small radius. These factors strongly influence the design of the enhancement, indicating use of enhancement elements of greater upstanding dimension from the wall and of smaller spacing, relative to water. Considering the low profile and wide element spacing of the enhancement actually tested, the approximately 1.9 factor of improvement is considered excellent.

We claim:

1. As an article of manufacture, a prefabricated condensation surface enhancement comprising a plurality of enhancement elements for collecting condensate from the surface between adjacent elements thereby thinning the condensate film on a portion of said surface between said adjacent elements and a plurality of strand-type connecting elements for supporting and maintaining the relative spacing of said enhancement elements said connecting elements crossing over and being attached to said enhancement elements such that they are essentially entirely spaced from the condensing surface position, said prefabricated network being formed from a wettable polymeric material.

2. The article of manufacture of claim 1, said surface enhancement being generally tubular, said enhancement elements being axially arranged along the generally tubular configuration, said connecting elements being generally helically arranged around the outer surfaces of said enhancement elements.

3. The article of manufacture of claim 1, said surface enhancement being generally tubular, said enhancement elements being generally helically arranged, said connecting elements also being generally helically arranged, the pitches of said respective helices being opposite to result in a nearly orthogonal relationship between said sets of elements.

4. The article of manufacture of claim 1, said prefabricated condensation surface enhancement being generally tubular, the unstressed effective internal circumference of said article being somewhat less than the external circumference of the condensing surface to which said article is to be applied such that when said article is stretched over said condensing surface, inwardly directed forces will maintain a touching relationship between said article and said surface and give rise to frictional forces to resist movement of said article relative to said surface.

5. An apparatus for film condensation comprising in combination a condensing surface and a prefabricated network of (a) spaced condensation enhancement elements for collecting condensate from the surface between adjacent enhancement elements thereby thinning the condensate film on a portion of said surface between said adjacent elements and (b) strand-type connecting elements affixed onto said enhancement elements for supporting and maintaining the relative spacing of said enhancement elements, said prefabricated network being formed of a wettable polymeric material and being applied to said condensing surface with at least a portion of said enhancement elements maintained in contact with said condensing surface and with said connecting elements essentially entirely spaced away from said surface in order not to interfere with collecting said condensate into draining rivulets.

6. The apparatus of claim 5, said condensing surface being curved and said prefabricated network being maintained in place by stresses in said elements, said stresses having components directed toward said condensing surface.

7. The apparatus of claim 5, both said condensing surface and said enhancement elements being vertically oriented.

8. The apparatus of claim 5, said condensing surface being a surface of a vertically oriented tube and said enhancement elements being generally axially arranged and spaced around the circumference of said tube surface.

9. The apparatus of claim 8, said connecting elements being generally helically arranged.

10. In an apparatus for film condensation comprising a surface condensing tube, the improvement comprising (a) a prefabricated network of condensation enhancement elements for collecting condensate from the surface between adjacent enhancement elements thereby thinning the condensate film on a portion of said surface between said adjacent elements and (b) strand-type connecting elements for supporting and maintaining the relative spacing of said enhancement elements, said prefabricated network being formed of a wettable polymeric material and being installable over said tube such that at least a portion of said enhancement elements are in contact with the condensing surfaces of said tubes and said connecting elements are essentially entirely spaced away from said condensing surfaces.

11. An apparatus for film condensation comprising in combination a condensing surface and a prefabricated network of spaced condensation enhancement elements for intercepting downwardly flowing condensate and redirecting said condensate for drainage and strand-type connecting elements for supporting and maintaining the relative spacing of said enhancement elements, said prefabricated network being formed from wettable polymeric material and being applied to said condensing surface with at least a portion of said enhancement elements maintained in contact with said condensing surface and with said connecting elements essentially entirely spaced away from said surface in order not to interfere with intercepting and directing said condensate for drainage.

12. The apparatus of claim 11, said condensation enhancement elements being oriented obliquely to the gravitational field to direct said condensate along said condensation enhancement elements and into localized drainage rivulets.

* * * * *